US005102312A

United States Patent [19]

Harvey

[11] Patent Number: 5,102,312

[45] Date of Patent: Apr. 7, 1992

[54] PUMP HEAD

[75] Inventor: Charles D. Harvey, Houston, Tex.

[73] Assignee: Butterworth Jetting System, Inc., Houston, Tex.

[21] Appl. No.: 575,182

[22] Filed: Aug. 30, 1990

[51] Int. Cl.[5] ..... F04B 21/02

[52] U.S. Cl. ..... 417/571; 417/569

[58] Field of Search ..... 417/571, 569, 563, 542

[56] References Cited

U.S. PATENT DOCUMENTS

| | | | |
|---|---|---|---|
| 2,230,501 | 2/1941 | MacArthur . | |
| 2,841,092 | 7/1958 | Whiteman et al. . | |
| 3,379,695 | 3/1968 | Yohpe . | |
| 3,427,988 | 3/1967 | Redman et al. | 417/569 |
| 3,598,418 | 8/1971 | Ward et al. | 277/165 |
| 3,669,576 | 6/1970 | Little et al. | 417/571 |
| 3,785,659 | 1/1974 | Maurer et al. | 277/35 |
| 3,811,801 | 5/1974 | Buse et al. | 417/454 |
| 3,870,439 | 3/1975 | Stachowiak et al. | 417/454 |
| 3,907,307 | 9/1975 | Maurer et al. | 277/69 |
| 4,141,676 | 2/1979 | Jannen et al. | 417/539 |
| 4,277,229 | 7/1981 | Pacht | 417/454 |
| 4,551,077 | 11/1985 | Pacht | 417/454 |
| 4,621,566 | 11/1986 | Johnson et al. | 92/13.4 |
| 4,758,135 | 7/1988 | Woodward et al. | 92/13.4 |

OTHER PUBLICATIONS

Irving H. Shames, "Mechanics of Fluid, 2nd Edition", McGraw-Hill Book Company, pp. 270.

Robert W. Fox, Alan T. McDonald, "Introduction to Fluid Mechanics" Third Edition, John Wiley & Sons, pp. 359-365.

"Partek H & L-300 Pumps by Butterworth," Butterworth Jetting Systems, Inc., 1987.

"Recommended Practices for the Use of Manually Operated High Pressure Water Jetting Equipment", *The Water Jet Technology Association*, 1985.

"The Liqua-Blaster" Butterworth, Inc., 1985.

"The Weatherford Advantage," Weatherford Water Jetting Systems, 1988, particularly pp. 6-7.

"Model No. 10250 Quintuplex Plunger Pump," NLB Corp., prior to Aug. of 1989.

"NLB Corp. Makes Water Work," *NLB Corp.* prior to Aug., 1989, particularly third page (unnumbered).

"Aqua Dyne," Aqua-Dyne Incorporated, (various excerpts) all prior to Aug., 1989.

*Primary Examiner*—Richard A. Bertsch

*Assistant Examiner*—Charles G. Freay

*Attorney, Agent, or Firm*—Jones, Day, Reavis & Pogue

[57] ABSTRACT

A pump head having a manifold with a fluid inlet and outlet, suction and discharge valves mounted in a channels valve seat cartridge for controlling fluid flow, and a plunger mounted in a fluid cylinder adjacent the valve seat cartridge for pumping fluid through the pump head, and, in one embodiment, high strength valve springs. A spring for valves in a pump head and methods for treating them.

6 Claims, 1 Drawing Sheet

PUMP HEAD

BACKGROUND OF THE INVENTION

1. Field of the Invention

This invention relates to pumps and, particularly to positive displacement pumps for high pressure applications, and to pump heads for such pumps.

2. Description of Related Art

High pressure pumps are used in water blasting systems to blast away scale, deck paint, rust or contaminants with a high pressure stream of water. Such systems have applications in oil refineries, chemical plants, oil field operations, offshore operations, and marine industries. Pumps capable of producing pressures up to 50,000 psi have been used with both water systems and water-and-sand-injection systems. These pressurizing pumps are designed to deliver high pressure water or other fluid and are usually based on positive displacement pistons or rubber/diaphragm/hydraulic systems. They may discharge the water or fluid into a common manifold to which are connected flexible hoses or rigid tubing which in turn have nozzles or lances connected to them. The pumps can be mobile or permanently mounted.

U.S. Pat. No. 3,870,439 (co-owned with this invention) discloses a pump head for a high pressure pump which is designed specifically for high pressure cleaning service. It has been made with stainless steel parts which afford corrosion resistance and relatively long service life and it has been provided with a modular design which permits quick and easy maintenance. The pump head can be overhauled in less than two hours and the suction and discharge valves are contained in a clamped valve seat that is easily removable for maintenance. The pump head also has self-adjusting plunger packing contained inside a removable cartridge for quick removal, inspections or replacement Peak pressures developed by the pump plunger, particularly during cavitation, are transmitted to the valve seat unit and to the pump plunger packing rather than to the much more expensive pump manifold.

Despite the advantages and success of the pump head of U.S. Pat. No. 3,870,439, failures have occurred while a pump with such a head operated above pressures of 12,500 p.s.i. High cyclic stresses at high pressures have caused such pump heads to fail due to metal fatigue at a variety of locations within the fluid end. Typical fatigue points include: the packing-cartridge-fluid-cylinder interface; the recess for a front bushing; a recess within the fluid cylinder for the packing spring; recess for the suction valve spring; and a recess for a discharge valve flow.

U.S. Pat. No. 4,758,135 (co-owned with this invention) discloses another pump head having a fluid cylinder connected to a retainer plate which is connected to a pump manifold. The manifold has an inlet recess containing a suction valve. This inlet recess communicates with a fluid cylinder recess in which is disposed a plunger. A packing cartridge is threadedly connected to and disposed partially within an end of the fluid cylinder. The plunger moves in the fluid cylinder recess and within a recess in the packing cartridge. The suction valve inlet recess communicates with both the fluid cylinder recess containing the plunger and with a discharge recess which contains a discharge valve. The discharge recess is sized such that turbulence occurs therein inhibiting flow. Packing is disposed within the fluid cylinder recess and extends into the recess within the packing cartridge nut. The packing serves the purpose of sealing between the plunger and the packing cartridge. The packing cartridge has a large outer diameter. A packing spring is placed within the fluid cylinder recess for urging the packing in a direction away from the retainer plate for the purpose of maintaining load on the packing to effect a seal between the plunger and the packing cartridge. O-ring seals are employed at either end of the packing cartridge nut for insuring the sealed contact of the nut and the fluid cylinder. Front and rear bushings (or front and rear "brasses") are provided within the fluid cylinder recess and the packing cartridge nut recess about the plunger for aligning the plunger within the pump. A lube channel is provided from the exterior of the fluid cylinder, through the packing cartridge nut, to the rear bushing for the purpose of providing lubrication to the rear packing. A "pony rod extension" connects a power end to the pump plunger and permits removal of the plunger from the pump head without having to remove the pump head from the power end. Capscrews are used to hold the manifold, retainer plate, and fluid cylinder in sealing contact. The suction valve is spring loaded so that it will close quickly. On the suction stroke water moves from the suction manifold, past the suction valve, and into the fluid cylinder. On the discharge stroke, the suction valve closes stopping flow through the fluid cylinder back into the suction manifold. A high pressure seal is located at the interface between the fluid cylinder and the packing cartridge. By decreasing the diameter of the high pressure seal, the load on the packing nut threads is reduced (since load is directly proportional to the area, i.e., also to the diameter; thus, as the diameter is decreased while pressure is held constant, the load is decreased).

In both of the prior art pump heads described above, a retainer plate is used for housing a valve seating cartridge. Removal of the valve seat cartridge for maintenance can, at times, be difficult particularly if debris wedges the cartridge in the retainer plate. With neither of the above-described prior art fluid ends is high volume capacity available when operating over a range of pressures from relatively low to relatively high pressures, e.g. from 4000 to 15000 p.s.i. with a flow rate varying from 10 to 65 gallons per minute in a quintiplex configuration (five individual fluid cylinders each with a plunger in a fluid end of a pump.) With the prior art pump heads the discharge valve and channel is significantly smaller than the suction valve and channel, restricting flow capacity. None of the above-described pump heads permits more than five interchangeable plunger sizes. This further limits these prior art devices' range of volume capacity. None of the above-described prior art devices discloses valve return springs strong enough to withstand increased volume capacity and constant recycling over long periods.

There has long been a need for a fluid cylinder for a pump head with a wide range of flow rates and pressures which permit a wide size range of interchangeable plungers. There has long been a need for springs for a pump head that do not fail in pumping increased volumes over long periods of operation. There has long been a need for a fluid end in which the valves are easily accessible.

In accordance with 37 C.F.R. §1.56, the following are disclosed, incorporated fully herein by reference, and copies are submitted herewith.

U.S. Pat. No. 3,870,439 (discussed above).

U.S. Pat. No. 4,758,135 (discussed above).

"NLB Corp. Makes Water Work," National Liquid Blasting Corporation.

"NLB Corp. Model 10250 Quintuplex Plunger Pump," NLB Corp.

"Aqua-Dyne Value-In-Line, Modular Block, Fluid End Conversion Kits" Aqua-Dyne Incorporated.

Partek H & L - 300 Pumps By Butterworth," Butterworth Jetting Systems, Inc., 1987.

"Partek's 'L' Design Fluid End," Butterworth Jetting Systems, Inc.

"The Weatherford Advantage," pp. 6–7, Weatherford Water Jetting Systems (1988).

SUMMARY OF THE PRESENT INVENTION

The present invention is directed to a pump head having a fluid cylinder, a valve seat cartridge in fluid communication with the fluid cylinder, a manifold in fluid communication with the valve seat cartridge, and a packing cartridge for housing a plunger and its associated packing and devices.

The pump head according to the present invention has no retainer plate for its valve seat cartridge. Capscrews extend through the manifold, the valve seat cartridge, and the fluid cylinder. Thus, access to valves and springs within the pump head is facilitated since no retainer plate needs to be manipulated or removed for such access. According to the present invention, a plunge recess has a portion in communication with an inlet valve channel and an outlet valve channel which contribute to significantly increased flow. Also, according to the present invention, an enlarged discharge cavity for the discharge valve extends from the valve seat cartridge to the manifold. This enlarged discharge cavity reduces turbulence in the discharge cavity thereby improving flow characteristics, including flow rate. This design permits the valve seat cartridge to be easily resurfaced and reworked to increase its useful life.

With increased flow capacity, there is an increased demand on valve return springs. According to one embodiment of this invention, a spring is provided which is made from spring wire of different materials than prior art springs and which is larger in diameter than prior art springs (0.047 v. 0.080); the wire is heat treated; high strength material wire is used; and the wire is also shot peened. Such springs perform surprisingly better than prior art springs.

It is, therefore, an object of the present invention to provide new, useful, unique, efficient, endurable, effective and nonobvious pump heads and springs for valves used in such pump heads.

Another object of the present invention is the provision of such fluid ends which can provide a wide range of flow rates and a wide range of operating pressures.

Yet another object of the present invention is the provision of such a fluid end in which inlet flow rate is comparable to outlet flow rate.

A further object of the present invention is the provision of such a fluid end with a wide variety of interchangeable plungers providing a wide variety of flow rates.

An additional object of the present invention is the provision of a fluid end with no retainer plate for a valve seat cartridge, but rather with a valve seat plate with an integral valve seat.

A particular object of this invention is the provision of high strength springs for use in pump heads.

Another object of this invention is the provision of such pump heads in which the valve seats and valves are easily accessible and maintainable.

Yet another object of the present invention is the provision of pump heads with valve seat cartridges which last longer and can therefore be resurfaced and/or reworked prolonging their useful lives.

A further object of the present invention is the provision of a pump head in which turbulence in a valve discharge channel is reduced.

The present invention recognizes and addresses the previously-mentioned long-felt needs and provides a satisfactory meeting of those needs in its various possible embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to ensure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

DESCRIPTION OF EMBODIMENTS PREFERRED AT THE TIME OF FILING OF THIS PATENT

Figure 1:
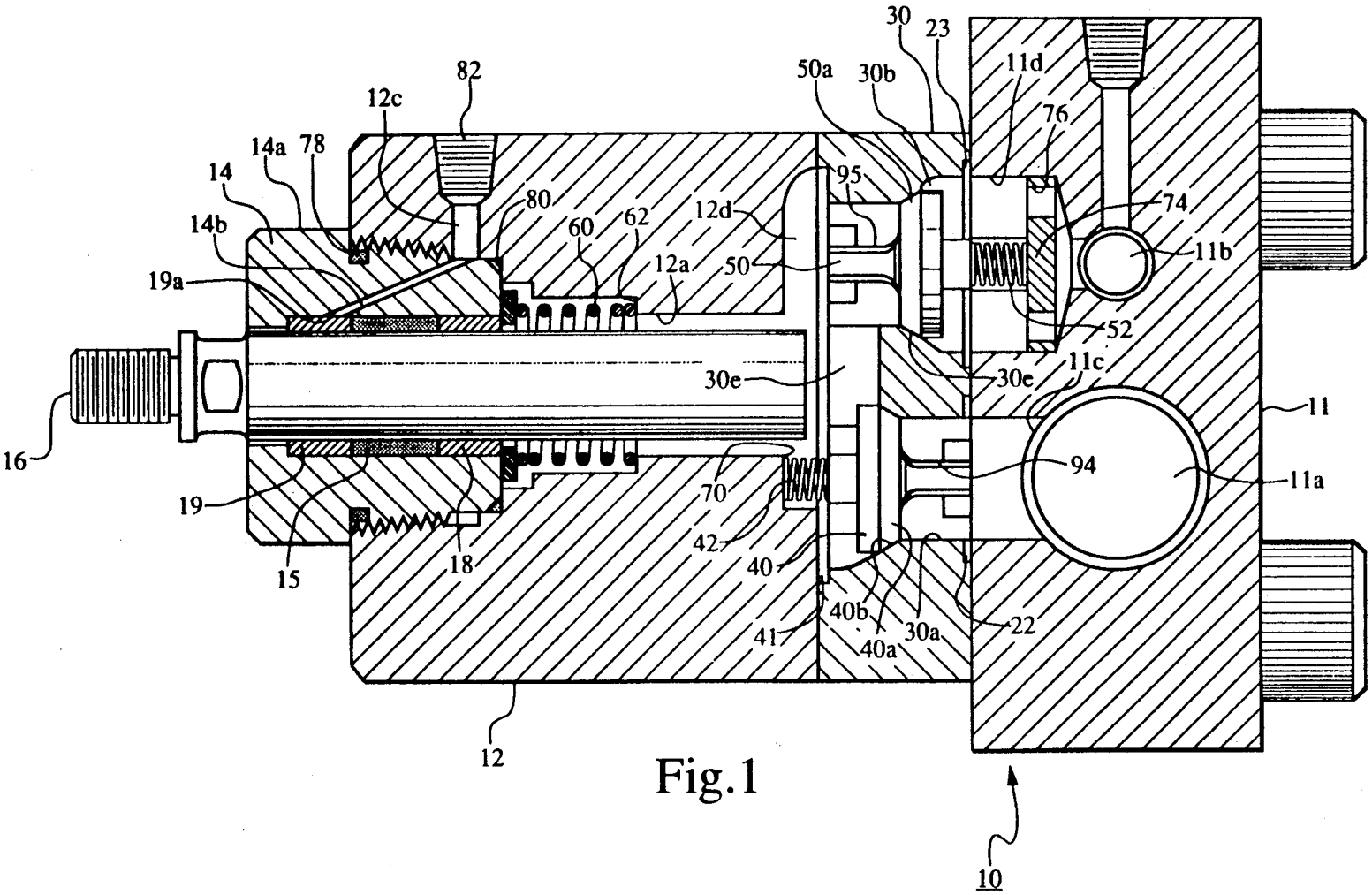
FIG. 1 is a cross-sectional side view of a fluid pump head according to the present invention.

In FIG. 1 the numeral 10 refers generally to one embodiment of a fluid end according to the present invention. A manifold block 11 is disposed adjacent to a valve cartridge 30. A fluid cylinder 12 is disposed adjacent to the cartridge 30. The fluid cylinder 12 has a packing cartridge 14 disposed therein and threadedly connected thereto through which a plunger or piston 16 moves in response to power supplied through a typical cross head (not shown).

The manifold 11 has an inlet opening **11*a* through which is supplied the fluid to be pumped. The manifold 11 also has an outlet opening 11*b* for the discharge of pumped fluid. The inlet opening 11*a* connects with a channel 11*c* which in turn communicates with an inlet valve channel 30*a*. The outlet opening 11*b* connects with a channel 11*d* which in turn communicates with an outlet valve channel 30*b*. The valve cartridge channels 30*a* and 30*b*** communicate via a valve cartridge channel 30c which itself communicates with a fluid cylinder flow area 12d. The flow area 12d is also in communication with the portions of channels 30a and 30b on the fluid cylinder side of the valve seat cartridge. To enhance sealing between the manifold 11 and the valve cartridge 30, O-ring seals 22 and 23 are disposed about the openings of the channels 30b and 30a, respectively. Sealing between the fluid cylinder and the valve seat cartridge is enhanced by O-ring 41.

The manifold 11, valve cartridge 30 and fluid cylinder 12 are secured together by cap screws 21 which extend through holes (not shown) thereby securing these elements together.

The valve cartridge 30 has two valves, an inlet suction valve 40 and an outlet discharge valve 50. The inlet valve 40 is disposed in the inlet channel 30a for movement therein and its valve member 40a seats upon an annular chamfered valve seat 40b which has a shape to conform with a corresponding surface on the valve member 40a for effectively closing off fluid flow through the channel 30a when the valve 40 is in the seated position. A spring 42 acts to keep the valve 40 seated until the pump operates on the suction stroke. The spring 42 is biased against a recess 70 in the fluid cylinder 12 mounted about a guide stem (not shown).

The valve 50 has a valve member 50a which is adapted to seat on the annular chamfered valve seat 30e of the outlet channel 30b. The valve 50 has a spring guide stem (not shown) around which is positioned a spring 52 which serves to seat the valve 50 until a predetermined pressure urging it to an unseated position is acting on the valve 50. The spring 52 is retained by a spring retainer 74 with holes 76 therein to facilitate flow.

The valve 40 permits fluid flow from the inlet opening 11a of the manifold 11 to the fluid cylinder 12, into the fluid cylinder flow area 12d and a fluid cylinder recess 12a within the cylinder 12 in which the plunger 16 reciprocates. During such flow the valve 50 is retained in seated or closed position. When the reverse occurs, and the plunger 16 moves toward the manifold 11, fluid is permitted to flow from the fluid cylinder recess 12a to the outlet opening 11b by opening the outlet discharge valve 50; the inlet suction valve 40 remains closed to prevent fluid from flowing out through the inlet opening 11a.

A variety of combinations of V-packings or chevron packing rings may be used for a packing 15.

A low pressure seal 78 and a high pressure seal 80 are provided between the packing cartridge 14 and the pump fluid cylinder 12.

Lubricant such as water is injected into a packing rear bushing 19 (preferably made of an aluminum-bronze alloy) through a lube inlet 82 in the fluid cylinder 12 which communicates with a lube channel 12c which in turn communicates with a lube channel 14b in the packing cartridge 14 and a lube hole 19a in the rear bushing 19. A front bushing 18 holds pressure on the packing 15 and provides some guidance for the plunger 16. A packing spring 60 abutting a shoulder 62 of the recess 12a biases the front packing bushing 18 against the packing 15.

In operation, the plunger 16 is connected to a pony rod extension (not shown) which is connected to a conventional cross head (not shown) which is in turn connected to a conventional prime mover (not shown) for reciprocating the plunger 16 within the fluid cylinder 12. The manifold 11 is connected to a source of fluid to be pumped, and the manifold outlet 11b is connected to a pipe, hose or receptacle which receives the fluid being pumped.

When the plunger 16 moves away from the manifold 11, the suction stroke occurs and fluid is drawn into flow area 12d and the recess 12a by flowing through the suction valve 40 from the inlet 11a of the manifold 11. At that time the valve 50 is closed by the spring pressure of the spring 52 and by the reduced internal pressure of the recess 12a which is less than the fluid pressure on the other side of the valve 50.

On the pumping stroke the plunger 16 moves towards the manifold 11, forcing fluid through the valve 50 and out of the manifold through the outlet opening 11b. At that time the valve 40 is closed.

The packing cartridge may be removed by wrenching the packing nut 14a thereby exposing the entire bore holding the packing 15, for inspection, repair, or replacement.

It is preferred that the channel for the inlet valve be substantially the same size as the channel for the outlet valve.

By providing the flow area 12d and permitting the intercommunication of it and the portions of the inlet and outlet valve channels, flow capacity is increased as compared to prior art valves. When the valve channels are the same size where the valves are mounted, the valves can be used interchangeably, i.e., only on type valve is needed. By increasing the flow area in channel 30b on the discharge side of the valve 50 and by increasing the flow area in channel 11d, turbulence in this area is reduced, improving flow characteristics thereby reducing flow restriction through the area.

It is preferred that springs, such as the springs 42 and 52, be made from a high-strength corrosion-resistant spring wire material [e.g. but not limited to Inconel 750× (TM) material] which after being formed into a spring is heat treated by heating it at about 1200° F. for about 4 hours to increase strength and then shot peening it to increase the fatigue life. After shot peening it is reheated to about 600° F. for about 30 minutes to stabilize the molecular structure of the material (i.e., relieve internal stresses). Various prior art springs lasted in a pump head according to the present invention for about 700 cycles and then lost resilience and failed to provide good spring action. Springs according to the present invention have lasted over 40,000,000 cycles.

One particular prior art spring was a compression spring with these characteristics:

Inside Diameter: 0.450 inches ±0.008 inches
Wire Diameter: 0.047 inches
Spring Rate: 12 pounds/inch
Coils: 4 to 5 active; 2 dead at each end; 8.5 total; end coils wound tight with pretension
Free Length: 0.75 inches ±0.03 inches
Material: 17-7 Stainless Steel
Ends: Squared, ground
Treatment: Passivated; Heat treated.

A particular spring according to this invention has these characteristics:

Inside Diameter 0.49 inches ±0.010 inches
Wire Diameter: 0.080 inches ±0.005 inches
Spring Rate: 80 pounds/inch ±10%
Coils: 6.1
Free Length: 0.812 inches
Material: Inconel×750
Ends: Squared, Ground
Treatment: [described above]

Since there is no retainer plate to hold a valve cartridge in a fluid end according to the present invention, access to the valves and valve seats is accomplished by removing the capscrews and separating the fluid cylinder from its mating valve cartridge. The valve cartridge can then be separated from the manifold and removed for inspection. The mating surfaces of the fluid cylinder and manifold can also be easily inspected. Prior art pump heads require removal of manifolds and retainer plates to gain access to the valves and valve seats and inspection of mating surfaces requires complete disassembly.

With a fluid end according to the present invention it is possible to use up to eight interchangeable plungers ranging in size and allowing flow rates as follows (quintiplex mode)

| Plunger Size (inches) | Flow Rate (gallons/minute) | Gallons/Stroke |
|---|---|---|
| 1. 13/16 | 18.5 | .007 |
| 2. ⅞ | 21.5 | .008 |
| 3. 15/16 | 24.7 | .009 |
| 4. 1 1/16 | 31.7 | .012 |
| 5. 1 3/16 | 39.6 | .014 |
| 6. 1 ¼ | 43.8 | .016 |
| 7. 1 ⅜ | 53.0 | .019 |
| 8. 1 ½ | 63.1 | .023 |

Prior art pump heads do not permit such a wide range of plunger sizes because the size of their packing cartridges and fluid cylinders are limited; e.g. with one prior art device, five plunger sizes are usable with flow rates ranging from 8 to 40 gallons/minute (quintiplex mode); with another prior art device, three plunger sizes are usable with flow rates ranging from 8 to 21 gallons/minute (quintiplex mode).

The prior art Butterworth L-300 and H-300 pump heads together provide a range of flow rates and pressures which are comparable to the flow rates and pressures which are possible with one pump head according to the present invention.

The increased flow capacity area within the fluid cylinder and vale seat cartridge of the present invention contribute significantly to increased flow rates. The flow capacity area of a valve seat cartridge and fluid cylinder of a pump head according to the present invention can be about 60% larger than a comparable area in a pump head according to the teachings of U.S. Pat. No. 3,870,439. Such an increased flow area can require larger (e.g. 1") capscrews.

For high pressure applications it is preferred that the manifold outlet ports have special extra strength threading and fittings, as well as safety threads (such as those in the prior art provided by Autoclave Engineers or Butech Systems).

It is preferred that the valve cartridge, manifold, fluid cylinder and valves of a pump head according to the present invention be made from a very high strength easily-machined material (e.g. 17–4 pH Stainless Steel, Condition H 1150 or Carpenter Custom 450 Stainless Steel).

Each of the valves 50 and 40 has a valve guide 95 and 94 respectively which serves to guide the valve members 50*a* and 40*a*.

In conclusion, therefore, it is seen that the present invention and the embodiments disclosed herein are well adapted to carry out the objectives and obtain the ends set forth at the outset. Certain changes can be made in the method and apparatus without departing from the spirit and the scope of this invention. It is realized that changes are possible and it is further intended that each element or step recited in any of the following claims is to be understood as referring to all equivalent elements or steps for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as others inherent therein.

What is claimed is:

1. A pump head comprising a manifold having an inlet suction opening and an outlet discharge opening, an integral valve cartridge member adjacent to and sealingly connected to the manifold, said valve cartridge member having an opening channel communicating with the manifold inlet suction opening and having a discharge channel communicating with the manifold outlet discharge opening, the valve cartridge member having suction valve means disposed in its opening channel for selectively closing off the opening channel and discharge valve means in the discharge channel for selectively closing off the discharge channel, a pump fluid cylinder adjacent to and sealingly connected to the valve cartridge, said pump fluid cylinder having a reciprocable plunger movably mounted in a pump fluid cylinder recess in the pump fluid cylinder, the pump fluid cylinder recess communicating with a fluid cylinder flow area which communicates with the valve cartridge opening channel and discharge channel, so that upon movement of the plunger away from the manifold the suction valve means permits fluid to flow from the manifold inlet suction opening into the fluid cylinder flow area and the fluid cylinder recess, and upon movement of the plunger toward the manifold the discharge valve means permits fluid to flow to the outlet discharge opening of the manifold, the pump fluid cylinder recess having an outer portion suitable for receiving and engaging a packing cartridge nut and the outer portion having an inner shoulder surface, means removably interconnecting the manifold, valve cartridge member and fluid cylinder so that the valve cartridge member can be removed for servicing by separation alone of the manifold from the fluid cylinder, a packing cartridge receivable in the pump fluid cylinder and having a plunger recess therein communicating with the pump fluid cylinder recess for movement of the plunger therein, the packing cartridge including a packing cartridge nut sealingly receivable in the pump fluid cylinder recess, the packing cartridge nut having a packing recess therein for holding packing for encircling the plunger and an opening through which the plunger movably extends.

2. The pump head of claim 1 wherein the opening channel and the discharge channel are substantially identical in size.

3. The pump head of claim 2 wherein the suction valve means and the discharge valve means are substantially similar in size.

4. The pump head of claim 1 wherein the discharge channel and the outlet discharge channel are sized to reduce turbulence of fluid discharged from the discharge channel.

5. The pump head of claim 1 wherein the manifold, valve cartridge member, and fluid cylinder are secured together with capscrews extending therethrough.

6. A pump head comprising a manifold having an inlet suction opening and an outlet discharge opening, a valve cartridge adjacent to and sealingly connected to the manifold, said valve cartridge having an inlet channel communicating with the manifold inlet suction opening and having an outlet channel communicating with the manifold outlet discharge opening, both the outlet discharge channel and the manifold outlet discharge opening being enlarged to a diameter greater than the discharge valve seat diameter to reduce fluid turbulence therein and increase the flow rate, the valve cartridge having suction valve means disposed in its opening channel for selectively closing off the opening channel and discharge valve means in the discharge channel for selectively closing off the discharge channel, the diameter of the seat for the discharge valve means being at least as great as the diameter of the seat for the suction valve means so as not to restrict flow capacity, a pump fluid cylinder adjacent to and sealingly connected to the valve cartridge, said pump fluid cylinder having a reciprocable plunger movably mounted in a pump fluid cylinder recess in the pump fluid cylinder, the pump fluid cylinder recess communicating with a fluid cylinder flow area which communicates with the valve cartridge opening channel and discharge channel, so that upon movement of the plunger away from the manifold the suction valve means permits fluid to flow from the manifold inlet suction opening into the fluid cylinder flow area and the fluid cylinder recess, and upon movement of the plunger toward the manifold the discharge valve means permits fluid to flow to the outlet discharge opening of the manifold, the pump fluid cylinder recess having an outer portion suitable for receiving and engaging a packing cartridge nut and the outer portion having an inner shoulder surface, a packing cartridge receivable in the pump fluid cylinder and having a plunger recess therein communicating with the pump fluid cylinder recess for movement of the plunger therein, the packing cartridge including a packing cartridge nut sealingly receivable in the pump fluid cylinder recess, the packing cartridge nut having a packing recess therein for holding packing for encircling the plunger and an opening through which the plunger movably extends, the manifold, valve cartridge, and fluid cylinder secured together with capscrews extending therethrough.

* * * * *